US007883344B1

(12) United States Patent
Felton et al.

(10) Patent No.: US 7,883,344 B1
(45) Date of Patent: Feb. 8, 2011

(54) ELECTRICAL CONNECTOR

(75) Inventors: Mickey Steven Felton, Sterling, MA (US); Joseph L. Brigham, Jr., North Attleborough, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 12/239,284

(22) Filed: Sep. 26, 2008

(51) Int. Cl.
*H01R 13/44* (2006.01)

(52) U.S. Cl. ..... 439/135

(58) Field of Classification Search ..... 439/135, 439/571, 567, 637, 636, 497, 378
See application file for complete search history.

(56) References Cited

U.S. PATENT DOCUMENTS 2,765,450 A * 10/1956 Richardson ..... 439/633
4,396,245 A * 8/1983 Lane ..... 439/148
4,780,095 A * 10/1988 Classon et al. ..... 439/637
4,872,851 A * 10/1989 Babuka et al. ..... 439/267
4,907,987 A * 3/1990 Douty et al. ..... 439/571
4,930,200 A * 6/1990 Brush et al. ..... 29/25.42
5,080,611 A * 1/1992 Hypes ..... 439/567
5,154,634 A * 10/1992 Brown et al. ..... 439/553
5,162,002 A * 11/1992 Regnier ..... 439/637
5,163,847 A * 11/1992 Regnier ..... 439/157
5,415,565 A * 5/1995 Mosquera ..... 439/567
5,419,712 A * 5/1995 Bellomo et al. ..... 439/327
5,449,297 A * 9/1995 Bellomo et al. ..... 439/630
5,470,240 A * 11/1995 Suzuki ..... 439/157
5,584,705 A * 12/1996 Lin ..... 439/157
5,620,342 A * 4/1997 Kinross ..... 439/637
5,704,807 A * 1/1998 Sherman et al. ..... 439/570
5,846,095 A * 12/1998 Bowen ..... 439/157
6,113,396 A * 9/2000 Tung ..... 439/62
6,132,228 A * 10/2000 Lang ..... 439/160
6,254,435 B1 * 7/2001 Cheong et al. ..... 439/637
6,315,614 B1 * 11/2001 Hassanzadeh et al. ..... 439/633
6,394,823 B1 * 5/2002 Dunham et al. ..... 439/108
6,648,682 B1 * 11/2003 Wu ..... 439/567
6,955,546 B1 * 10/2005 Huang ..... 439/135
2008/0081514 A1 4/2008 Ng et al.

* cited by examiner

*Primary Examiner*—T C Patel
*Assistant Examiner*—Vladimir Imas

(57) ABSTRACT

An electrical connector having a dielectric housing. The housing has an elongated, vertically extending portion and a base portion. The base portion extends laterally beyond the elongated, vertically extending portion. The connector includes a pair of retention posts disposed through a portion of a base of the connector. The base of the housing has an alignment pin deposed between the retention posts for extending into a hole in the surface of the printed circuit board. A pair of dust cover members is insertable into side-walls of the housing.

3 Claims, 9 Drawing Sheets

ELECTRICAL CONNECTOR

TECHNICAL FIELD

This invention relates generally to electrical connectors and more particularly to electrical connectors used to connect electrical components to printed circuit boards (PCBs).

BACKGROUND

As is known in the art, electrical connectors are often used in electrical components, such for example, disk drive units to a PCB. The connector generally includes dielectric housing having therein an array of electrical terminals extending through the housing. A distal end of the connector is configured to have inserted therein the disk drive unit, with electrical contacts of the unit making electrical contact with distal ends of the electrical terminal. The proximal ends of the terminals are adapted to be soldered to electrical contacts disposed on a surface of the PCB with the terminals extending perpendicularly outwardly from the surface of the PCB. Thus, the electrical connector has a base adapted to mount to the planar surface of the PCB with sidewalls of the PCB extending perpendicular to the surface of the PCB.

SUMMARY

In accordance with the present invention, an electrical connector is provided having a dielectric housing and an array of electrical terminals extending through the housing. The housing has an elongated, vertically extending portion and a base portion, the base portion extending laterally beyond the elongated, vertically extending portion. The array of electrical terminals extends through the elongated, vertically extending portion and the base portion. A distal end of the elongated, vertically extending portion is configured to have inserted therein an electrical unit with electrical contacts of the unit making electrical contact with distal ends of the electrical terminals. Proximal ends of the terminals are adapted to be soldered to electrical contacts disposed on a surface of a printed circuit board with the terminals extending perpendicularly outwardly from the surface of the printed circuit board. The base portion is adapted to mount to the planar surface of the printed circuit. A pair of retention posts is disposed through a portion of the base extending laterally beyond the elongated, vertically extending portion, such retention posts being disposed adjacent lateral ends of the base for extending into the surface of the printed circuit board. The base of the housing has an alignment pin disposed between the retention posts for extending into a hole in the surface of the printed circuit board.

In one embodiment, a pair of dust cover members is insertable onto sidewalls of the housing to provide walls between the proximal ends of the terminals and the soldered printed circuit board contacts and regions exterior to such proximal ends of the terminals and soldered printed circuit board contacts.

With such arrangement, the soldering is performed with the dust covers removed and the electrical connection between the proximal ends of the terminals and the printed circuit board contacts can be visually inspected. After such inspection, the dust cover can be affixed to the sidewalls to prevent dust and other material from getting onto the contacts/terminals.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
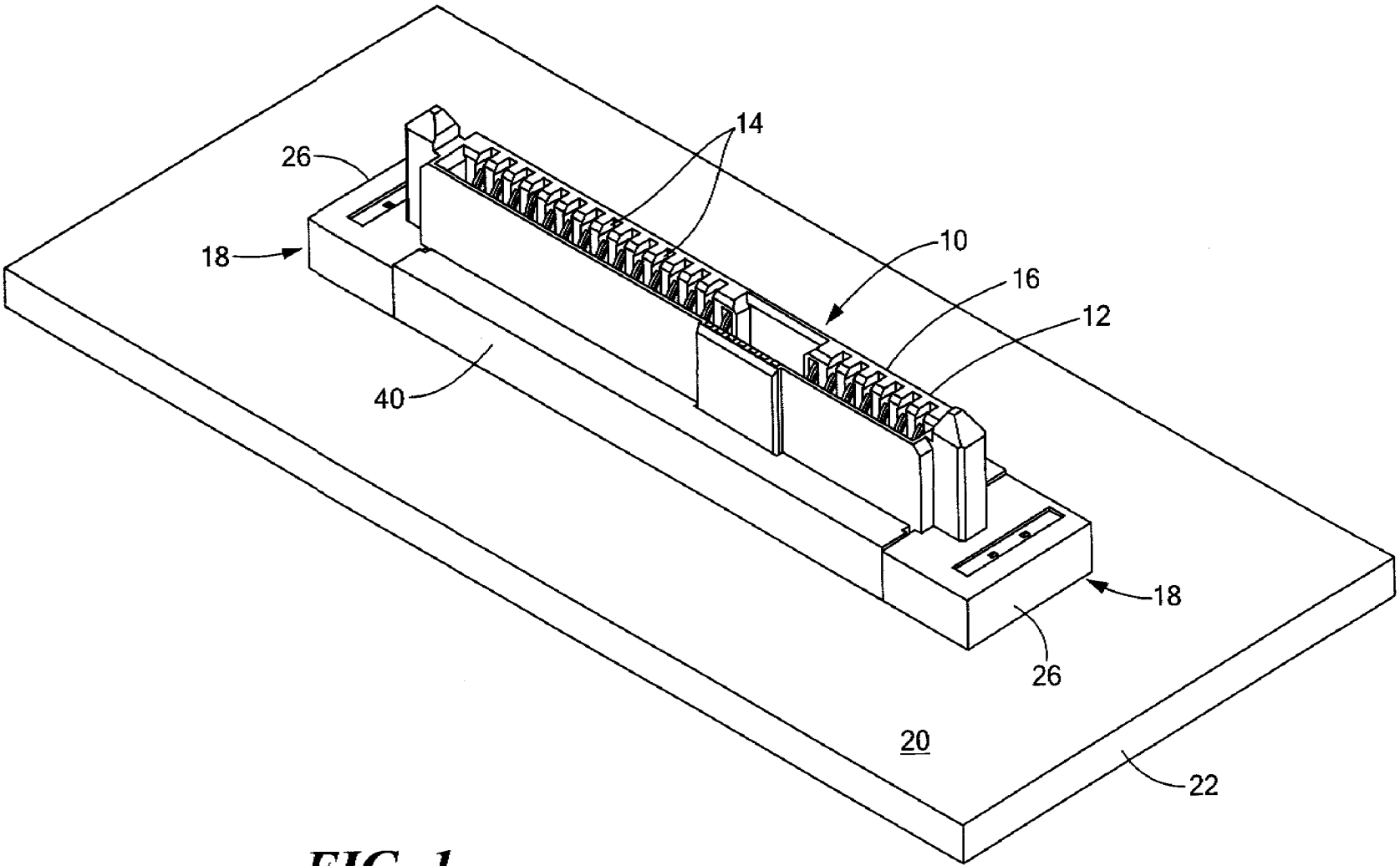
FIG. 1 is an perspective view of an electrical connector and a printed circuit board connected together according to the invention.
Figure 5:
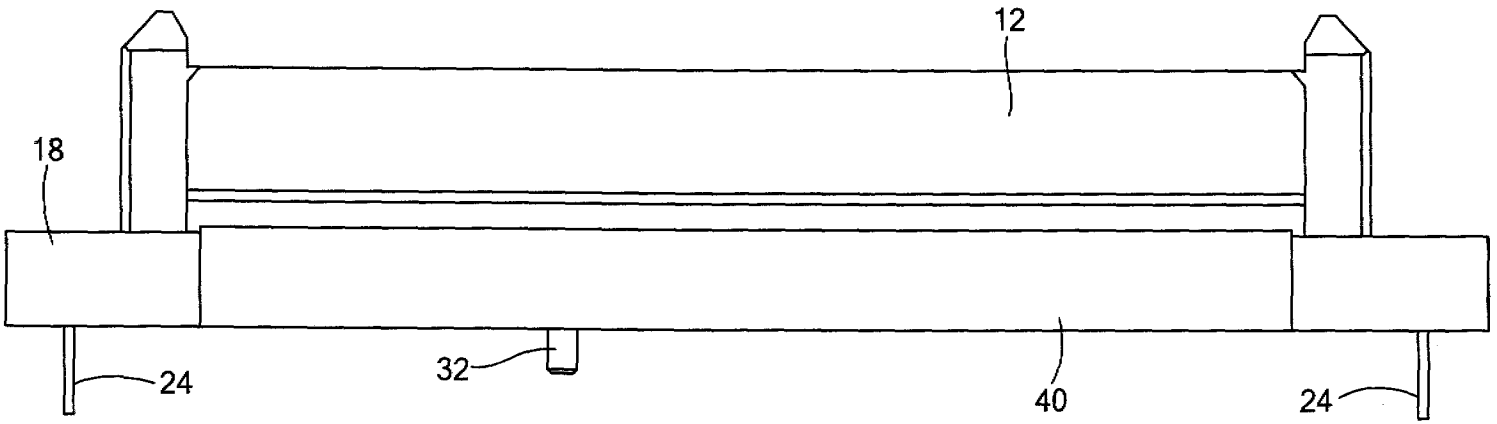
FIG. 5 is a side elevation view of the electrical connector of FIG. 1 according to the invention.
Figure 6:
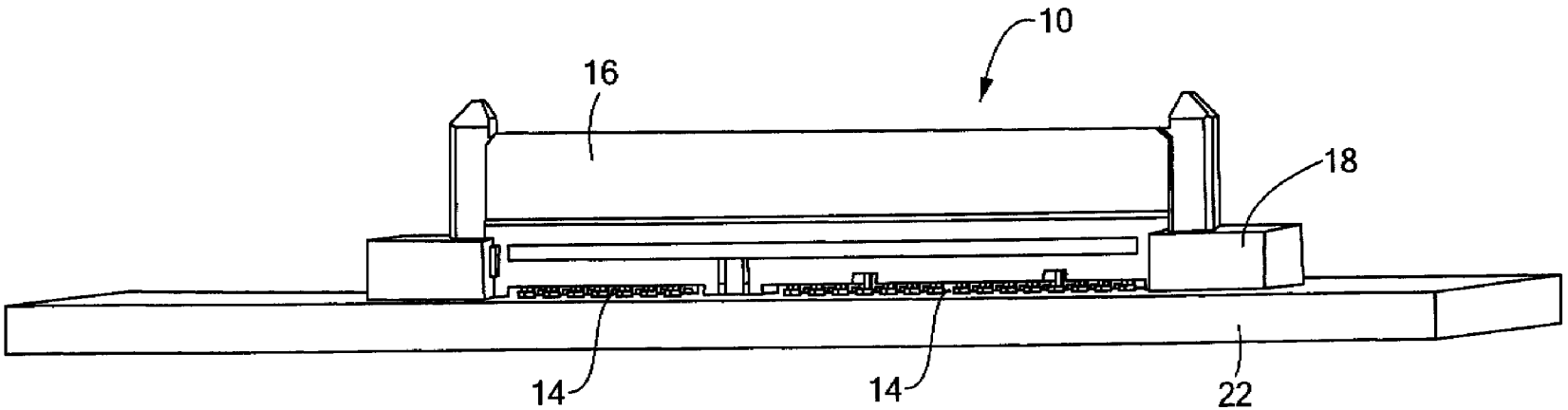
FIG. 6 is a side elevation view of the electrical connector of FIG. 1 according to the invention with one of a pair of dust covers of such electrical connector being removed.
Figure 7:
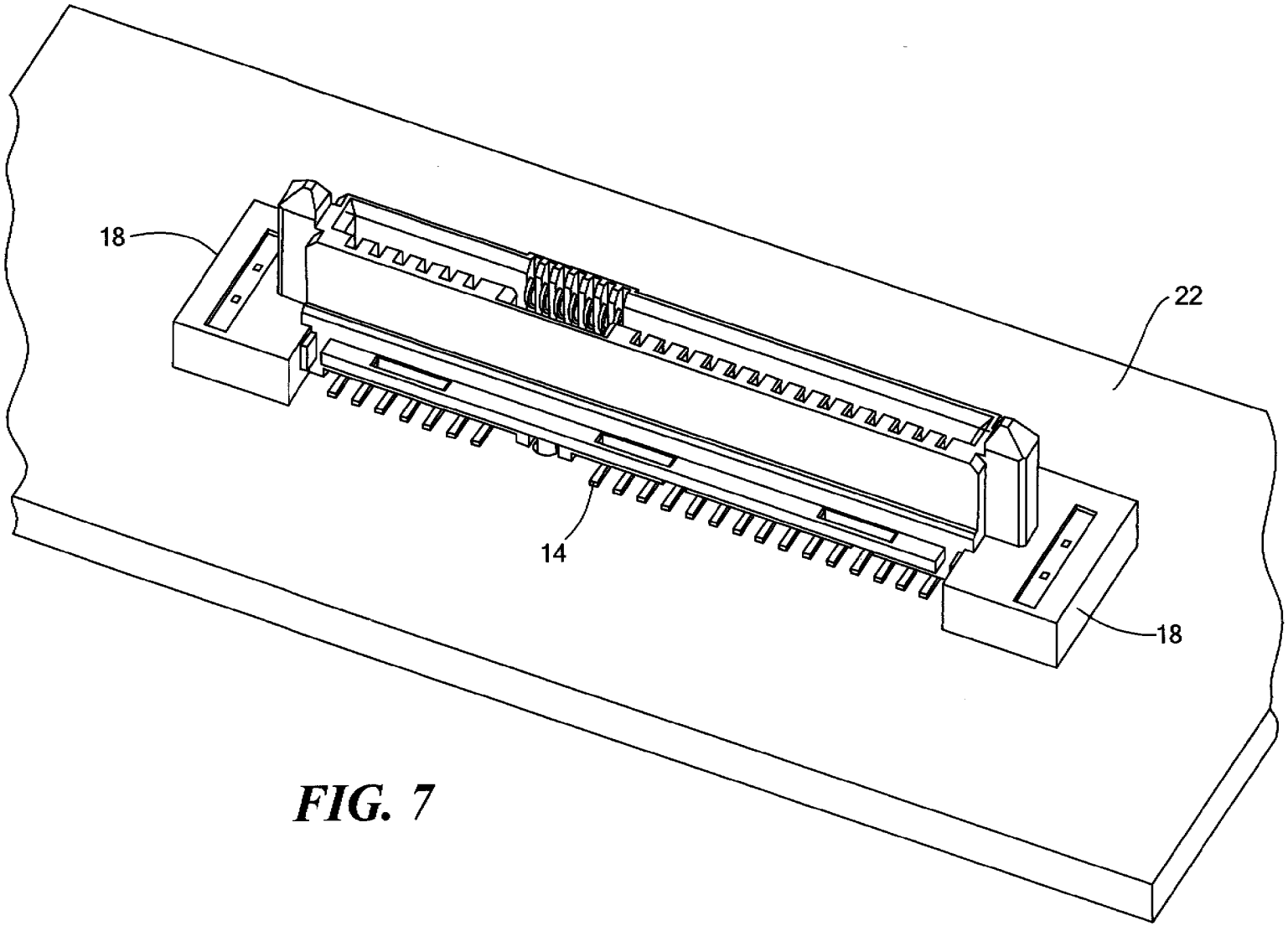
FIG. 7 is a side perspective view of the electrical connector of FIG. 1 according to the invention with one of a pair of dust covers of such electrical connector being removed.
Figure 8:
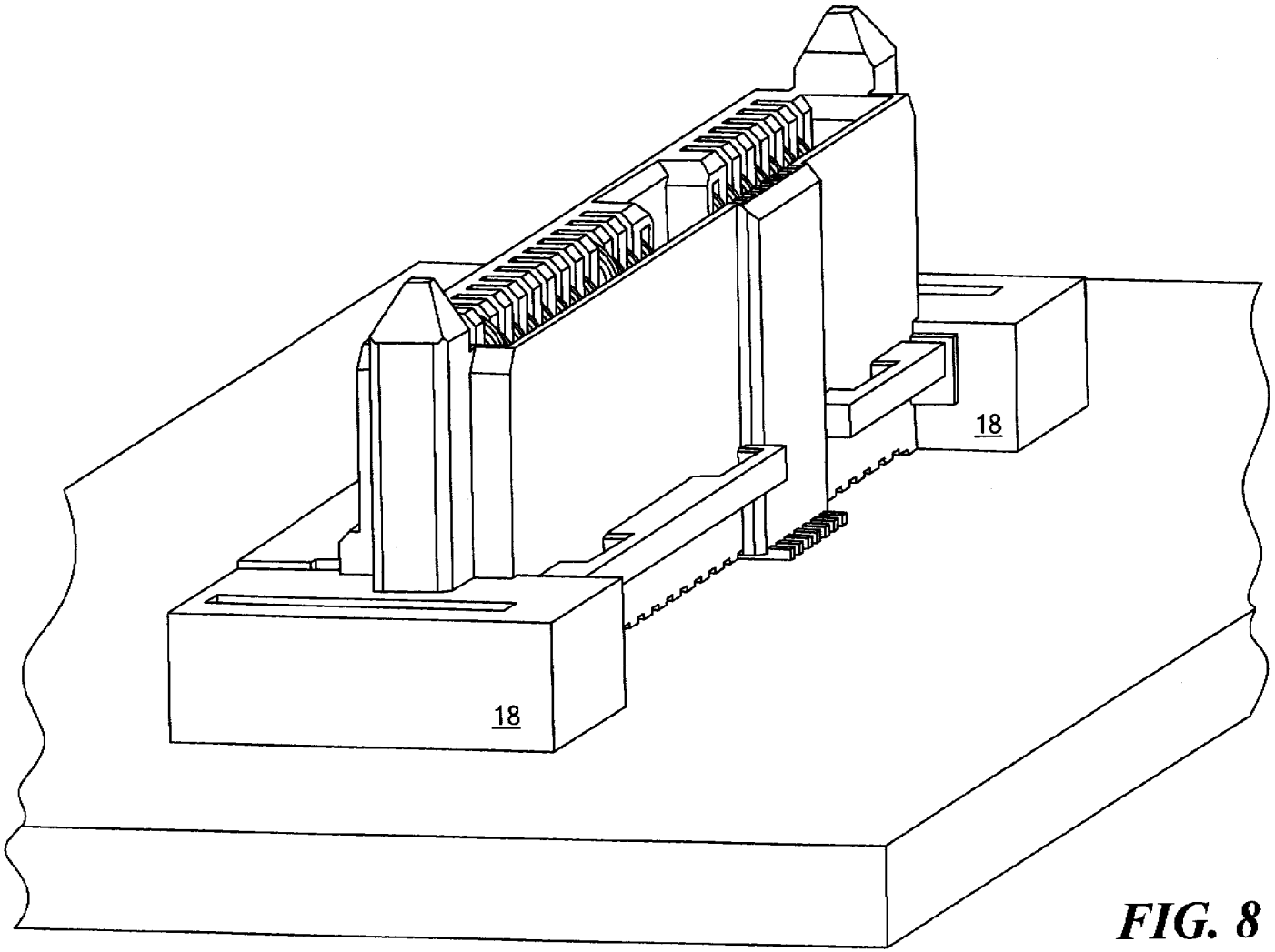
FIG. 8 is a different side perspective view of the electrical connector of FIG. 1 according to the invention with one of a pair of dust covers of such electrical connector being removed.

Referring now to FIGS. 1 and 5, an electrical connector 10 is provided having a dielectric housing 12 and an array of electrical terminals 14 extending through the housing 12. The housing 12 has an elongated, vertically extending portion 16 and a base portion 18, the base portion 18 extending laterally beyond the elongated, vertically extending portion 16, as shown. The array of electrical terminals 14 extends through the elongated, vertically extending portion 16 and the base portion 18. A distal end of the elongated, vertically extending portion (i.e., the upper end in FIG. 1) is configured to have inserted therein an electrical unit (not shown) with electrical contacts of the unit making electrical contact with distal ends of the electrical terminals 14. Proximal ends of the terminals 14 (i.e., the lower ends in FIG. 1) are adapted to be soldered to electrical contacts, not shown, disposed on the upper surface 20 of a printed circuit board 22 with the terminals extending perpendicularly outwardly from the surface 20 of the printed circuit board 22. The base portion 18 is adapted to mount to the planar surface 20 of the printed circuit board 22 with the elongated, vertically extending portion 16 extending perpendicular to the surface 20 of the printed circuit board 22.

Figure 2:
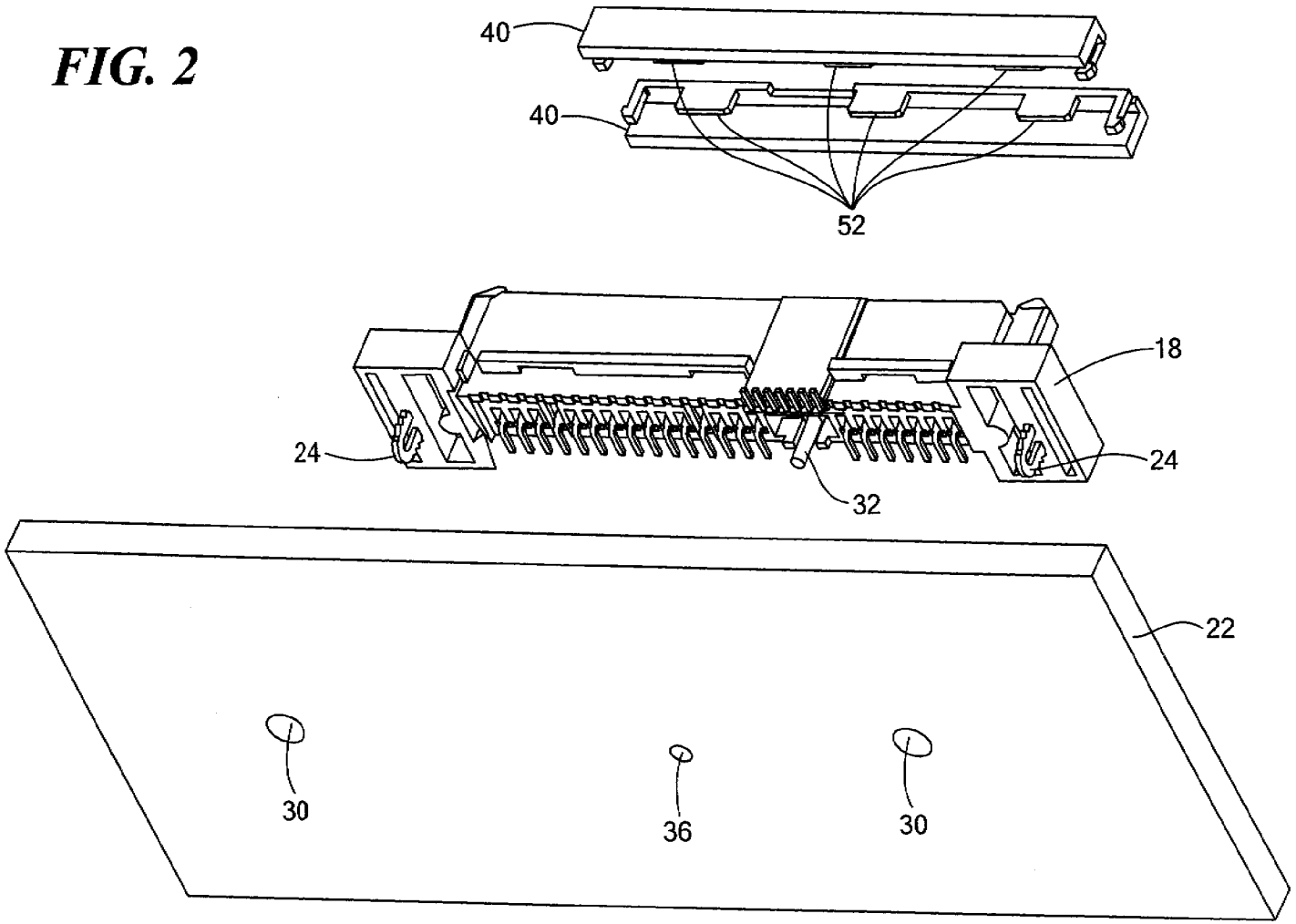
FIG. 2 is an exploded perspective view of a lower portion of the electrical connector of FIG. 1 and a printed circuit board connected together according to the invention.
Figure 3:
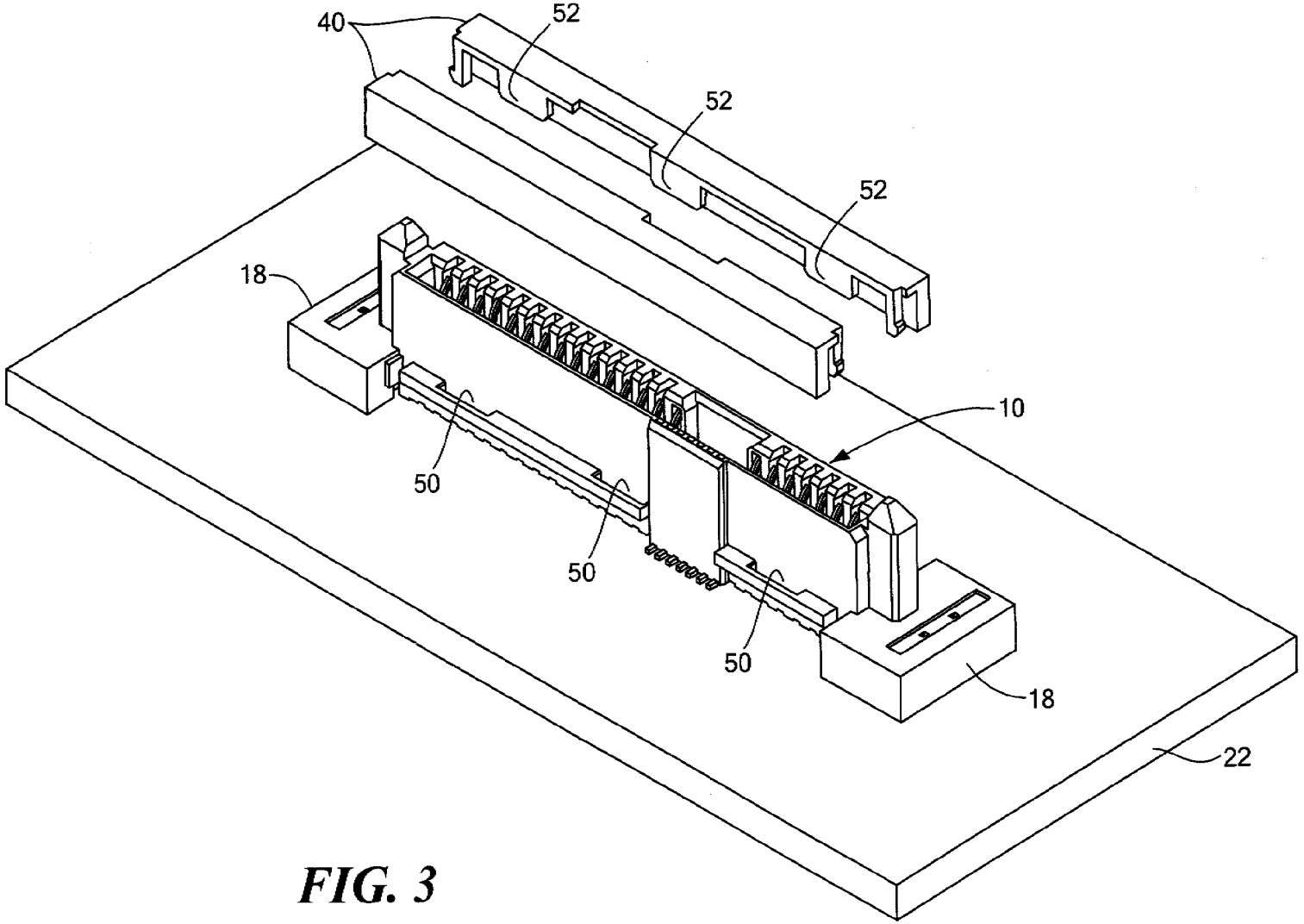
FIG. 3 is different exploded isometric view of a lower portion of the electrical connector of FIG. 1 and a printed circuit board connected together according to the invention
Figure 4:
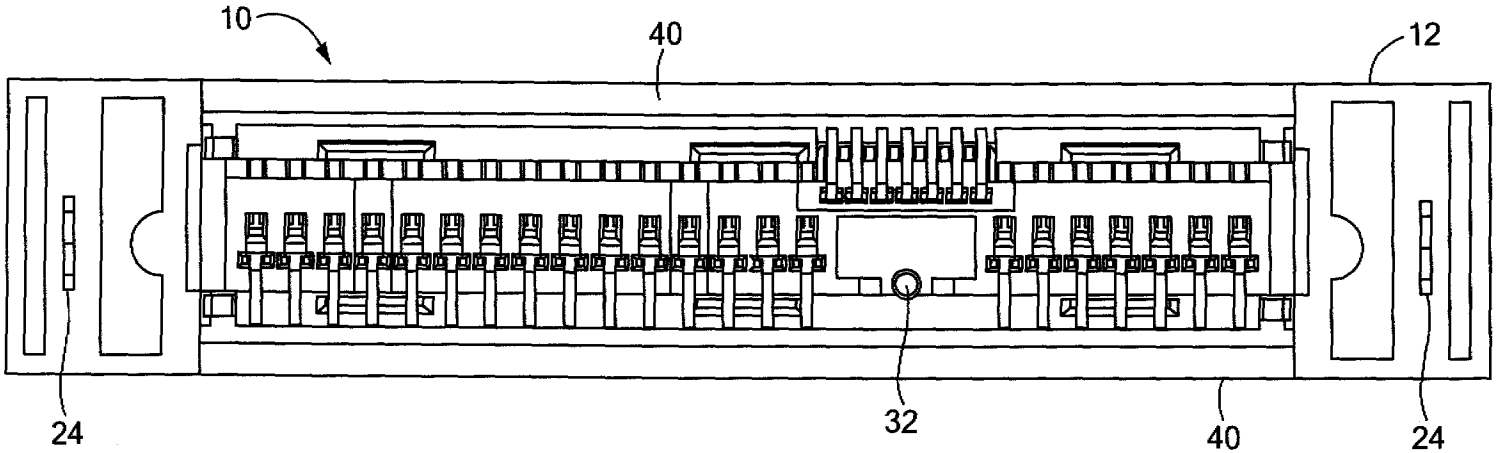
FIG. 4 is a bottom view of the electrical connector of FIG. 1 according to the invention.

A pair of retention posts 24 (FIG. 2) is disposed through the base 18. The retention posts 24 are disposed adjacent lateral ends 26 of the base 18 for extending into holes 30 in the surface 20 of the printed circuit board 22, as shown in FIG. 3. The base 18 has an alignment pin 32 (FIG. 2) disposed between the retention posts 24 for extending into a hole 36 in the surface of the printed circuit board 22.

Figure 9:
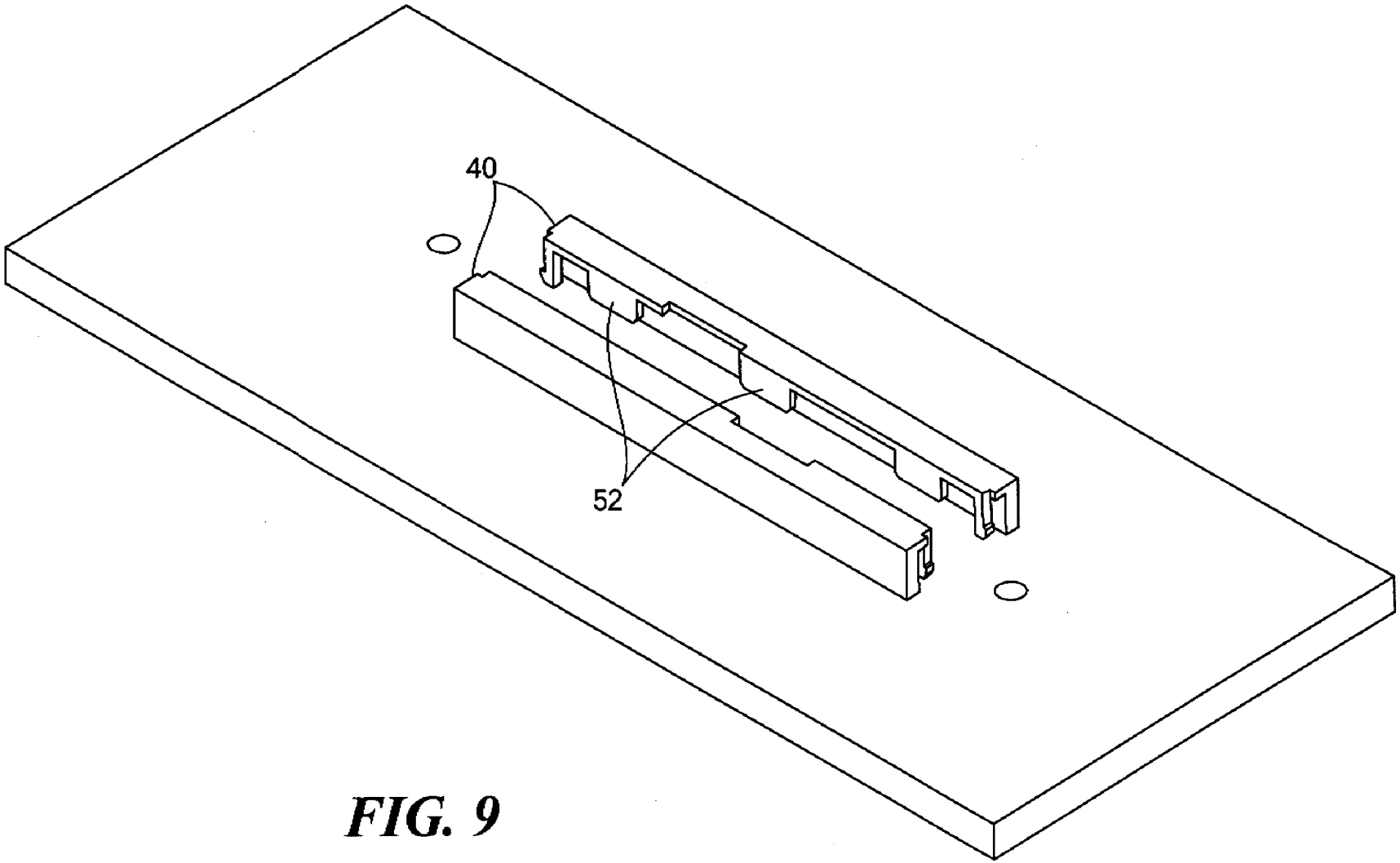
FIG. 9 is a side perspective view of the pair of dust covers of the electrical connector of FIG. 1.
Figure 10:
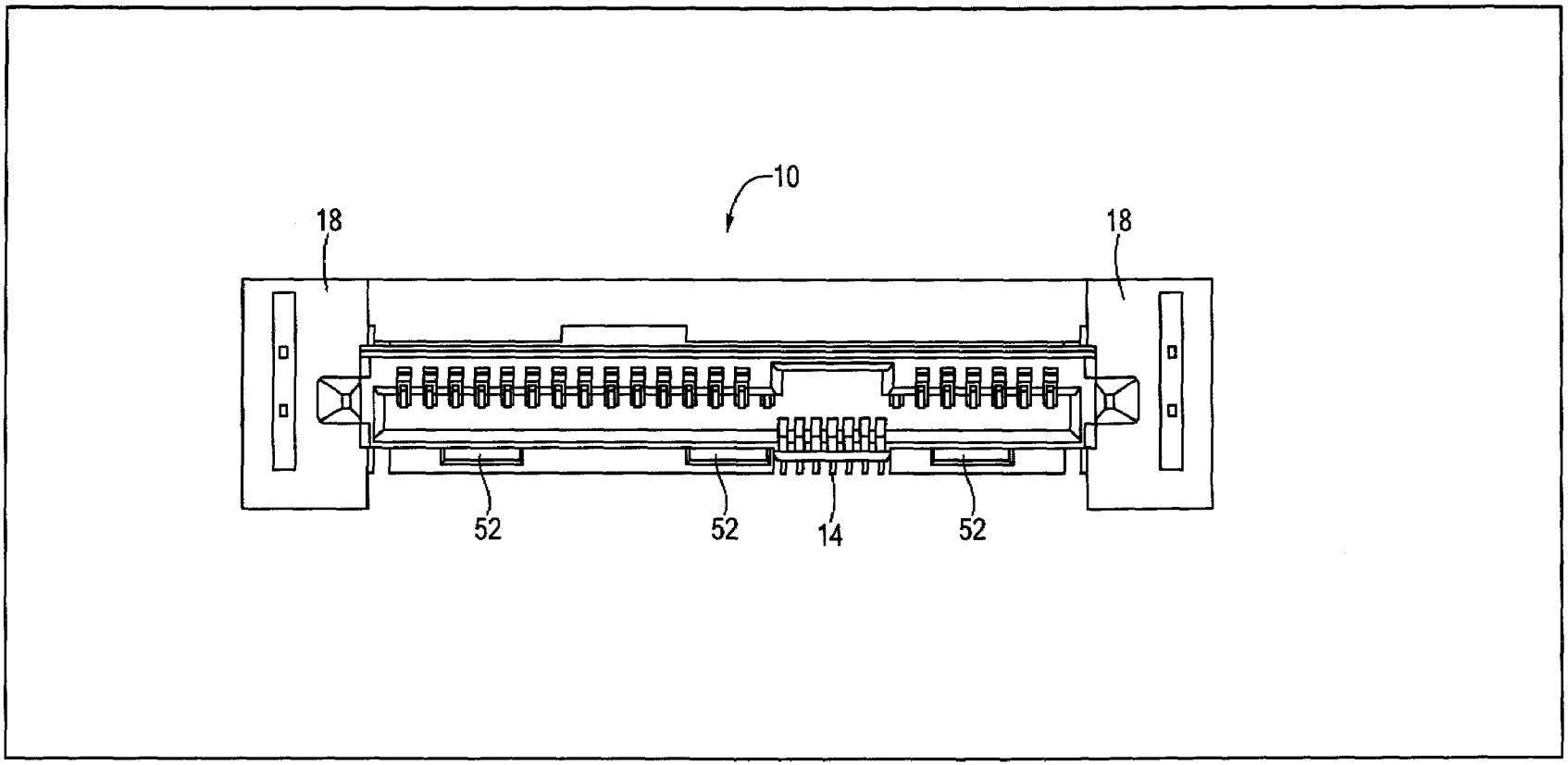
FIG. 10 is a top view of the electrical connector of FIG. 1 according to the invention with one of a pair of dust covers of such electrical connector being removed.

A pair of dust cover members 40 (FIGS. 1, 2, 3, 4, 6, 7, 8, 9, and 10, only one being shown in FIG. 10) is insertable into sidewalls of the housing 12 to provide walls between the proximal ends of the terminals 14 and the soldered printed circuit board contacts (not shown) and regions exterior to such proximal ends of the terminals and soldered printed circuit board contacts. More particularly, the housing 12 is form with slots 50 (FIGS. 3 and 10), here three slots 50, configured to receive tabs 52 (FIGS. 2 and 9) formed in the members 40.

With such arrangement, the soldering is performed with the dust covers removed and the electrical connection between the proximal ends of the terminals and the printed circuit board contacts can be visually inspected. After such inspection, the dust cover can be affixed to the sidewalls to prevent dust and other material from getting onto the contacts/terminals.

A number of embodiments of the invention have been described. Nevertheless, it will be understood that various modifications may be made without departing from the spirit and scope of the invention. Accordingly, other embodiments are within the scope of the following claims.

What is claimed is:

1. An electrical connector comprising:

dielectric housing, such housing having an elongated, vertically extending portion and a base, the base having a pair of base sections extending laterally beyond the elongated, vertically extending portion;

an array of electrical terminals extending through the elongated, vertically extending portion and the base;

wherein a distal end of the elongated, vertically extending portion is configured to have inserted therein an electrical unit with electrical contacts of the unit making electrical contact with vertically extending distal ends of the electrical terminals;

wherein proximal ends of the terminals are adapted to be soldered to electrical contacts disposed on a surface of a printed circuit board with the proximal ends of the terminals extending horizontally outwardly from the base;

wherein the base is adapted to mount to the planar surface of the printed circuit;

wherein the housing has slots in sidewalls thereof and;

a pair of dust cover members having tabs inserted into the slots in the sidewalls of the housing.

2. The electrical connector recited in claim 1 wherein the slots are disposed between the pair of base sections.

3. The electrical connector recited in claim 2 including a pair of vertically extending retention posts, each one being disposed through a corresponding one of the pair of the base sections extending laterally beyond the elongated, vertically extending portion for insertion into holes in the surface of the printed circuit board; and wherein the base has a vertically extending alignment pin disposed under the elongated, vertically extending portion and between the retention posts, the alignment post extending vertically beyond the proximal ends of the terminals for extending into a hole in the surface of the printed circuit board.

* * * * *